United States Patent [19]

Krahler et al.

[11] Patent Number: 4,517,376

[45] Date of Patent: May 14, 1985

[54] MANUFACTURE OF CHLOROMETHYL-SUBSTITUTED POLYFLUOROALKYL ESTERS

[75] Inventors: Stanley E. Krahler; William R. Remington, both of Wilmington, Del.

[73] Assignee: E. I. Du Pont de Nemours and Company, Wilmington, Del.

[21] Appl. No.: 410,516

[22] Filed: Aug. 23, 1982

Related U.S. Application Data

[63] Continuation-in-part of Ser. No. 338,617, Jan. 11, 1982, abandoned, which is a continuation-in-part of Ser. No. 39,162, May 15, 1979, abandoned.

[51] Int. Cl.[3] ..... C07C 69/76

[52] U.S. Cl. ..... 560/87; 560/111; 560/180; 560/223; 560/266

[58] Field of Search ..... 560/87, 111, 180, 223, 560/266

[56] References Cited

U.S. PATENT DOCUMENTS 3,927,126 12/1975 Huber-Emden ..... 260/633

4,052,485 10/1977 Huber-Emden ..... 260/928

*Primary Examiner*—Paul J. Killos

[57] ABSTRACT

Compounds having the formula:

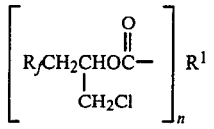

(I.)

wherein $R_f$ is perfluorinated saturated aliphatic containing 3–20 carbons;

$R^1$ is optionally substituted alkyl, aryl, aralkyl or cycloalkyl; and n is a number from 1 to 4.

Process for preparing compounds (I):

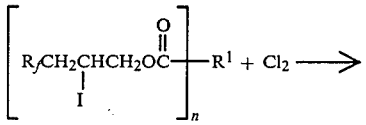

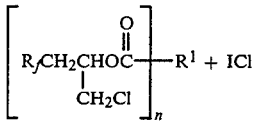

The reaction can be carried out, e.g., by melting an iodine-substituted polyfluoroalkyl ester and contacting the molten ester with chlorine, or an iodine-substituted polyfluoroalkyl ester can be suspended or dissolved in a suitable liquid and reacted with chlorine. A suitable liquid is inert under the reaction conditions; e.g. alcohols or water should be avoided. Process of using compounds (I) to treat (a) textile materials so as to give them dry soil resistance and oil and water repellency, and (b) paper so as to make it repel water and oil.

10 Claims, No Drawings

MANUFACTURE OF CHLOROMETHYL-SUBSTITUTED POLYFLUOROALKYL ESTERS

BACKGROUND OF THE INVENTION

Cross-Reference To Related Applications

This application is a continuation-in-part of application Ser. No. 338,617, filed Jan. 11, 1982, which in turn is a continuation-in-part of application Ser. No. 39,162, filed May 15, 1979 both abandoned.

This invention relates to chloromethyl-substituted polyfluoroalkyl esters of polybasic acids and their use in treating a variety of substrates, such as textile fabrics and paper, so as to provide the substrate with soil resistance as well as water and oil repellency. It relates further to a process for preparing the compounds of this invention wherein iodine-substituted polyfluoroalkyl esters are reacted with elemental chlorine in which the iodine-substituted esters are in the molten state or dissolved or suspended in an inert liquid.

Polymers and other compounds containing highly-fluorinated segments have been used for imparting dry soil resistance as well as oil and water repellency to textile substrates. Resistance to dry, traffic-caused soiling in carpets prepared from polyesters, polyamides and polyacrylics is said to be provided by fluoropolymeric coatings, e.g., polymers of perfluoroalkyl acrylates and methacrylates. Highly fluorinated mono- and polycarboxylic acid esters have been used to provide dry soil resistance and resistance to burning; U.S. Pat. Nos. 3,923,715 and 4,029,585. Other esters derived from perfluoroethanol and a mono- or polycarboxylic acid are disclosed in U.S. Pat. No. 3,716,401.

U.S. Pat. No. 3,856,849 discloses perfluoroalkyl esters of alkenyl carboxylic acids of the formula

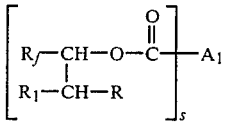

wherein $R_f$ is a perfluorinated hydrocarbon radical (1–22 carbons); R is H or $CH_3$; $R_1$ is Cl, unsubstituted or substituted phenyl or alkoxy; $A_1$ is an ethylenically unsaturated hydrocarbon (2–3 carbons) and s is an integer from 1–3. The patent discloses using polymerization products formed from the esters for rendering porous or non-porous substrates oil-, water- and dirt-repellent or to provide soil-release-anti soiling finishes.

U.S. Pat. No. 4,264,484 discloses fluorochemical compositions useful in carpet treatment comprising esters having fluoroaliphatic radicals as well as chloro substituents. The patent indicates that the esters can be prepared from mono- or polycarboxylic acids and an alcohol having the formula $$R_f(Q)_m—A—OH$$

wherein $R_f$ is fluoroaliphatic;

Q is a divalent group, e.g., —CO—, —CONR—, —$SO_2$NR—, —$SO_2$—, —$C_nH_{2n}$—, —$C_6H_4$—, —$C_6H_3Cl$—, —$OC_2H_4$—, or combinations thereof;

R is H or lower alkyl;

n is 1–20;

m is 0 or 1; and

A is a divalent moiety having 2–30 carbons and containing at least one chlorine atom.

Although the disclosure and claims of U.S. Pat. No. 3,145,222 do not otherwise contemplate such a compound, it discloses the compound, $C_3F_7CH_2CHICH_2O_2CCH_3$, and indicates it may be hydrolyzed and treated with alkali to give a polyfluoroepoxy polymer intermediate.

U.S. Pat. No. 4,034,022 discloses isomers having the formula

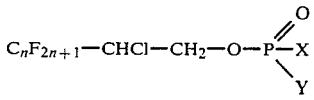

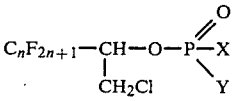

wherein $C_nF_{2n+1}$ is a perfluorinated aliphatic chain; n is 2 to 18; X and Y are each halogen, hydroxyl, the group OM in which M is a metallic equivalent, alkoxy, chloroalkoxy, hydroxypolyalkyleneoxy, aryloxy, or —NZZ' in which Z and Z' are each a hydrogen atom or an alkyl, cycloalkyl or aryl. It is stated the compounds may be used, inter alia, as hydrophobic and oleophobic agents.

SUMMARY OF THE INVENTION

This invention relates to compounds having the formula:

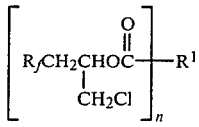

wherein $R_f$ is a saturated fluorinated aliphatic containing at least 3 carbons;

$R^1$ is optionally substituted alkyl, aryl, aralkyl or cycloalkyl; and n is a number from 1 to 4, preferably 2 to 4. It relates also to a method for preparing the compounds of this invention, and to a process of using compounds of this invention to treat textile materials so as to give them dry soil resistance and oil and water repellency. This invention relates still further to a process for the treatment of paper so as to make it repel water and oil.

DETAILED DESCRIPTION OF THE INVENTION $R_f$ is a saturated, monovalent, non-aromatic, aliphatic radical which is fully fluorinated. The chain may be straight, branched or cyclic, and may be interrupted by divalent oxygen atoms or trivalent nitrogen atoms bonded only to carbon atoms. In a preferred embodiment, the fluorinated aliphatic radical contains not more than 20 carbon atoms because such a large radical results in inefficient use of the fluorine content. In a more preferred embodiment, $R_f$ is a perfluoroalkyl containing 3 to 20 carbons.

The compounds of this invention can be prepared by the reaction set forth in the following equation

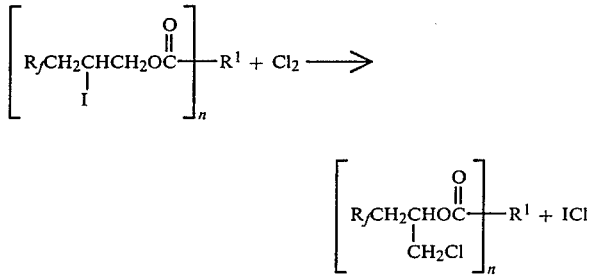

While most of the iodine will be present in the ultimate reaction mixture as ICl, some elemental iodine will be present. Moreover, some $ICl_3$ may be present. The iodine substituted polyfluoroalkyl ester starting material for the preparation of the compounds of this invention can be prepared by the reaction set forth in the following equation

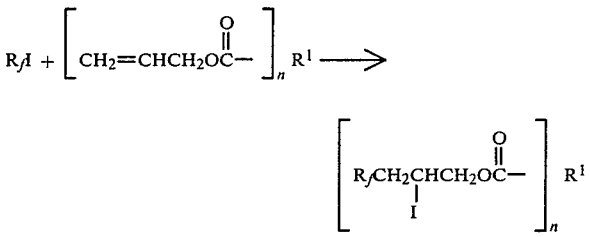

A wide variety of allyl esters can be used according to this invention. In a preferred embodiment, $R^1$ is alkyl, aryl, aralkyl or cycloalkyl. Thus, for example, $R^1$ can be the residue remaining after esterification of citric, phthalic (o, m or p isomer), benzoic, succinic, chlorendic, benzene polycarboxylic acids, such as trimellitic, pyromellitic and the like.

The reaction of the iodine-substituted polyfluoroalkyl ester with chlorine can be carried out by melting the iodine-substituted polyfluoroalkyl ester and contacting the molten ester with chlorine, or the iodine-substituted polyfluoroalkyl ester can be suspended or dissolved in a suitable liquid and reacted with chlorine. A suitable liquid is inert under the reaction conditions; e.g. alcohols or water should be avoided since they would be expected to react. Preferred liquids include 1,1,2-trichloro-1,2,2-trifluoroethane, 1,1,1,2-tetrachloro-2,2-difluoroethane and tetrachloromethane. It is possible also to use chloroform. All such halocarbons function as solvents for the iodine substituted polyfluoroalkyl ester starting material. Although it is not necessary that the liquid medium be a solvent for that ester, it is preferred that the ester be at least partially soluble in the liquid medium.

The reaction of the iodine-substituted polyfluoroalkyl ester with chlorine is mildly exothermic, being somewhat more exothermic at the start of the reaction than at a point near its completion. When a solvent is used for the ester starting material, reflux thereof provides effective control of the exotherm. The temperature of the reaction with chlorine is not critical nor is pressure. One can run the reaction at a temperature between 0° C. and the melting point of the iodine-substituted polyfluoroalkyl ester. Usually, the reaction is run at a temperature between about 40° and 55° C. when a solvent is used, and between about 85° and 90° C. when the ester starting material is molten during the reaction with chlorine. Although the reaction, whether in solution or in molten form, is usually run at atmospheric pressure, elevated pressures can be used as well. Normally, the reaction is run until essentially all of the covalently bound iodine is displaced from the ester.

Normally, a slight excess of chlorine, over that required to satisy the reaction given above, is used. Introducing chlorine in excess of the amount which is required to displace all iodine in the ester starting material will do no harm, but such an excess does nothing in aid of the reaction either. However, if the $R^1$ moiety has some tendency to react with chlorine, it may be desirable to avoid a large excess of chlorine. In that way, if the $R^1$ moiety reacts relatively slowly with chlorine, it may be possible to carry the desired displacement of iodine to completion before a significant amount of chlorine reacts with the $R^1$ moiety.

After all of the iodine has been displaced from the ester, it is best to convert the iodine chloride(s) and iodine, if any, to iodide and chloride ions. For example, one can add water and a soluble salt such as sodium bisulfite for that purpose.

The preparation of the iodine-substituted polyfluoroalkyl ester is carried out in the presence of a free radical initiator at temperatures in the range between about 50° and 140° C. and at pressures between about 1 and 50 atmospheres. If the polyfluoroalkyl iodide or the allyl ester used in the reaction has a boiling point below the desired reaction temperature, a pressure system would be used; otherwise, the reaction may be carried out at atmospheric pressure. The free radical initiator may be either an azo compound or a peroxy compound, e.g. $\alpha,\alpha'$-azobis-(isobutyronitrile); 2,2'-azobis-(2,4-dimethylvaleronitrile); acetyl peroxide; benzoyl peroxide; di-t-butyl peroxide and the like.

The polyfluoroalkyl iodides can be prepared by a variety of reactions. See for example Brace et al., *JACS*, 73, 4016 (1951); Krespan, *J. Org. Chem.*, 23, 2016 (1958); Haszeldine, *J. Chem. Soc.*, 1949, 2856; 1952, 4259; 1953, 376; Hauptschein et al., *JACS*, 79, 2549 (1957).

The principal use of compounds of this invention involves application of solutions or aqueous dispersions of said compounds to carpets, other woven or nonwoven textiles, or paper. The desirable characteristics imparted by the application of said compounds include water repellency, oil repellency, and resistance to soiling. The degree to which said desirable characteristics are achieved is evaluated in different ways for the different substrates.

For example, in the case of carpets, dry soil resistance provides a measure of the ability of the carpet to retain its new appearance under normal traffic conditions. In addition, oil and water repellency is required in carpets to provide resistance to staining by spilled liquids.

In most of the other end uses, achievement of the desired effects is assayed simply by measuring oil and/or water repellency. That may be done by drop tests as reported in Tables 3, 4 and 6 by penetration as reported in Table 5.

Application of the novel compounds of this invention from solution or aqueous dispersion to any of the foregoing substrates may be carried out in any known manner so as to deposit on the substrate from about 0.01% to 1.0% of the novel compound, based on the dry weight of the substrate. Preferably, application of the novel compounds of this invention is made from an aqueous dispersion. Subject to the above-defined range of quantities of the novel compounds being deposited on the substrate, the aqueous dispersions of compounds of this invention can be blended with an aqueous polymeric suspension. For example, addition of an aqueous suspension of polymethyl methacrylate, makes a composition which can be diluted with water for application to the various substrates contemplated by this invention. The presence of the polymeric suspension, such as an aqueous polymethylmethacrylate, improves dry soil resistance. Such a dispersion, before dilution with water, will normally contain from about 2% to about 20% of fluorinated ester of this invention and between about 2% and about 40% of the polymer, dry basis, provided by the above-mentioned suspension. For application to textile substrates, such as carpets, the above-described dispersion is diluted still further with water. Application can be made by any known technique, such as padding, exhaust, spraying, and the like.

After a compound (or compounds) of this invention, as a solution or dispersion and optionally containing other components such as, for example, poly(methylmethacrylate), has been applied to the desired substrate, it will usually be dried to remove water and/or solvent. Normally, drying is effected by heating to about 120°-170° C., although higher or lower temperatures may be used. In particular, drying at ambient temperature is frequently sufficient, although heating is usually preferred to hasten the drying. Furthermore, repellency effects frequently are improved by heat treatment beyond that required for drying. It appears that such treatment at least partially melts the composition of this invention so that it spreads and more effectively coats the substrate.

The oil repellency test used herein is an adaptation of AATCC Method 118-1978. Oil repellency is defined as the ability of a substrate to resist wetting by oily liquids. According to the test method, drops of standard test liquids, consisting of a selected series of hydrocarbons with varying surface tensions, are placed on the substrate and observed for wetting. The oil repellency rating is the highest numbered test liquid which will not wet the surface of the substrate within a period of 30 seconds. Wetting of the surface of the substrate is normally evident by a darkening thereof at the interface. On black or dark surfaces, wetting can be detected by a loss of "sparkle" within the drop. The standard test liquids are set forth in Table 1.

TABLE 1

| Standard Test Liquids | |
|---|---|
| Oil Repellency Rating Number | Composition |
| 1 | "Nujol" |
| 2 | 65/35 "Nujol"/n-hexadecane by volume at 70° F. (21° C.) |
| 3 | n-hexadecane |
| 4 | n-tetradecane |
| 5 | n-dodecane |
| 6 | n-decane |
| 7 | n-octane |
| 8 | n-heptane |

"Nujol" is the trademark of Plough, Inc., for a mineral oil having a Saybolt viscosity of 360/390 at 100° F. (38° C.) and a specific gravity of 0.880/0.900 at 60° F. (15° C.).

The water repellency test provides an index of aqueous stain resistance in that, generally, the higher the water repellency rating, the better the resistance to staining by water-based substances. Like the oil repellency rating, the water repellency rating is the highest numbered test liquid which will not wet the surface of the substrate in a specified amount of time, in this case 10 seconds. The standard test solutions are those of Table 2.

TABLE 2

| Standard Test Solutions | | | | |
|---|---|---|---|---|
| Water Repellency Rating Number | Composition | | Flash Point (TCC) | |
| | % Isopropanol* | % $H_2O$** | °C. | °F. |
| 1 | 2 | 98 | — | — |
| 2 | 5 | 95 | 50 | 122 |
| 3 | 10 | 90 | 40 | 104 |
| 4 | 20 | 80 | 28 | 82 |
| 5 | 30 | 70 | 19 | 66 |

*Reagent Grade, percentage by volume
**Distilled

In accordance with the test procedure, one begins with the lowest numbered test liquid (Water Repellency Rating No. 1), and carefully places one drop thereof at each of three locations on the surface of the substrate. If after 10 seconds two of the three drops are still visible in spherical or hemi-spherical form, drops of the next higher numbered test liquid are placed in an adjacent site and observed for 10 seconds. The above-described procedure is continued until at least two or the three drops of the test liquid fail to remain spherical or hemispherical 10 seconds after application.

The following examples are given by way of illustration, not by way of limitation. Unless otherwise indicated, all parts and percentages are by weight; temperatures are expressed in degrees Centigrade and pressures in mm of Hg.

In some of the examples that follow, the term MPI has been used as an abbreviation for Mixed Perfluoroalkyl Iodides of the formula, $C_nF_{2n+1}I$, having the following composition (average n=8):

| n | Weight % (Approximate) |
|---|---|
| 4 | 1-2 |
| 6 | 27-28 |
| 8 | 32-34 |
| 10 | 20-22 |
| 12 | 8-11 |
| 14 | 4-5 |
| 16 | 1-2 |
| >16 | small amounts |

It is not necessary that mixed perfluoroalkyl iodides be used in making compounds of this invention. In addition, mixed perfluoroalkyl iodides other than the foregoing can be used, e.g. a mixture of the above formula having the composition (average n=6):

| n | Weight % (Approximate) |
|---|---|
| 4 | 3 |
| 6 | 52 |
| 8 | 30 |
| 10 | 11 |
| 12 | 3 |
| 14 | 1 |

In the examples that follow, the term ABI is an abbreviation for 2,2'-azobis-(isobutyronitrile). Moreover, in those examples, the term "deoxygenated" means that the material so treated was stirred overnight at ambient temperature under a current of nitrogen or stirred for at least one hour at about 60° C. under a current of nitrogen. In the examples, "nonionic surfactant" means the product of the reaction of 15 moles of ethylene oxide with 1 mole of a mixture of n-dodecanol-1, n-tetradecanol-1, and n-hexadecanol-1. "Arquad" 18–50 means a 50% solution of octadecyl trimethyl ammonium chloride in water.

EXAMPLE 1

Preparation of Adduct

| | |
|---|---|
| MPI | 146 g |
| Triallyl trimellitate | 26.4 g |
| ABI | 1.65 g |

The MPI and the triallyl trimellitate were mixed and deoxygenated. Then, while maintaining a nitrogen atmosphere, the ABI was added portionwise over a period of about 24 hours on the following time schedule:

| Elapsed Time (Hours) | Temperature | ABI Addition |
|---|---|---|
| 0 | 65° C. | 0.2 g |
| 2⅓ | 64° C. | 0.2 g |
| 3-1/12 | 67° C. | 0.2 g |
| 5-5/6* | 64–72° C. | 0.4 g |
| 24 | raised to 99° C. | 0.65 g |
| | Total | 1.65 g |
| 24¾ | reaction terminated | |

*The reaction mass was heated so that the temperature was raised to 72° C.

Preparation of Dispersion and Testing on Nylon Carpet

| | |
|---|---|
| Adduct | 100 g |
| Methylisobutyl ketone | 50 g |
| "Arquad" 18–50 | 6 g |
| Nonionic surfactant | 3 g |
| Water | about 125 g |
| 2-Methyl-2,4-pentanediol | 0.5 g |

All components were combined at 50°–80° C. in a blender, agitated therein for about 10 minutes, and then passed twice through a Manton-Gaulin homogenizer (2 stages, 500 and 6000 psi). The methyl isobutyl ketone was then distilled out, along with some water, using a partial vacuum and temperatures up to about 55° C.

A portion of the finished dispersion was diluted with water and mixed with acetic acid and an aqueous dispersion of polymethylmethacrylate (PMMA). The PMMA in the dispersion had an inherent viscosity of about 0.7 (0.5 g of PMMA in 100 ml of acetone at 30° C.), and was made up of particles having an average size of about 0.06 micron. The mixed dispersion comprising the adduct, acetic acid, PMMA and water was then sprayed onto the face of nylon carpet so that the face fibers of the carpet received 0.055% of fluorine (in covalently bound form), 0.186% of polymethylmethacrylate, 0.01% of acetic acid, and about 25% of $H_2O$ based on the weight of the fiber. The carpet was dried for 30 minutes in a forced air oven at 270° F. Samples of the carpet were tested for oil and water repellency. Samples thereof were also tested for dry soil resistance by being placed in a heavily-travelled hallway along with untreated samples of the same carpet, being rated for soil-resistance in comparison with the untreated carpet. The results of testing of the carpet samples are set forth in Table 3.

Another portion of the finished dispersion was diluted with water and mixed with acetic acid. It was then sprayed onto the face of nylon carpet so that the face fibers thereof received 0.055% of fluorine (in covalently bound form), 0.01% of acetic acid and about 25% of water. The treated carpet was then dried and tested as described above, giving the data set forth in Table 4.

EXAMPLE 2

Preparation of Triallyl Citrate Adduct

| | |
|---|---|
| MPI | 820 g |
| Triallyl citrate | 161 g |
| ABI | 9.5 g |

The MPI and 47 ml of the triallyl citrate were mixed and deoxygenated overnight. The next day, the following schedule was followed:

| Elapsed Time (min) | Temperature (°C.) | ABI Addition (g) | Triallyl Citrate Addition (ml) |
|---|---|---|---|
| 0 | 25 (heating) | 0.5 | |
| 30 | 64 | | |
| 45 | 62 | | 5 |
| 70 | 65 | | 20 |
| 88 | 65 | | 10 |
| 96 | 64 | | 10 |
| 125 | 66 | | 15 |
| 146 | 71 | 1.0 | |
| 158 | 72 | | remainder |
| 158–270 | 72–91 | | |
| 330 | 81 | 2.0 | |
| 375 | 81 | 2.0 | |
| 414 | 81 | 4.0 | |
| 441 | 81 | Shut down overnight (cold time not counted) | |
| 441–486 | 88–100 | | |
| 486 | 95 | Reaction terminated | |

Dispersions of the product of this example, with and without polymethyl methacrylate, were prepared by the procedures described in Example 1. Separate portions thereof were applied to carpet samples and tested as in Example 1, the results thereof being recited in Tables 3 and 4.

EXAMPLE 3

In a round-bottom flask fitted with a reflux condenser maintained at 0° C. were placed 320 g of the product of Example 1 and 120 ml of 1,1,2-trichloro-1,2,2-trifluoroethane. The mixture was stirred at 48°–52° C. and 36 g of chlorine gas were introduced below the surface of the liquid over a period of 75 minutes. This mixture was left at room temperature overnight. The next morning, the temperature was held in the range of 43°–52° while 40 ml of water and then 140 ml of a saturated aqueous solution of sodium bisulfite were added. The temperature was raised to 80° to distill out the 1,1,2-trichloro-1,2,2-trifluoroethane. At the same temperature, 100 ml of methyl isobutyl ketone were added, followed by about 147 ml of 20% aqueous sodium hydroxide to bring the pH to 5.4. Then, 120 ml of methyl isobutyl ketone and 60 g of $MgSO_4.7H_2O$ were added, and after the latter dissolved, the lower aqueous layer was removed in a separatory funnel. To the organic layer was added 200 ml of a hot aqueous solution of $MgSO_4.7H_2O$ (saturated at about 60° C.). After mixing well at 80° C., the lower aqueous layer was discarded. The organic layer was washed with 200 ml of water at 80° C., and the product in methyl isobutyl ketone formed the bottom layer. The upper layer was discarded, and after evaporation of part of the methyl isobutyl ketone in the bottom layer, 339 g of residue were obtained. A sample thereof was dried in a vacuum oven and found to be 67.5% non-volatile. That corresponds to 229 g of dry product which is 83% of the theoretical yield.

The structure of the product is as follows:

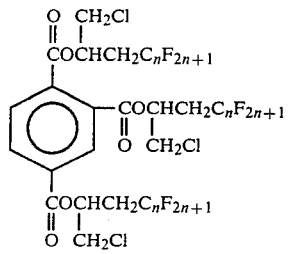

wherein n is the same as given in the definition of MPI. The structure of the product was established by NMR spectroscopy and is supported by elemental analysis. The latter gives the following results for n with an average value of 8:

| Element | Calc. % | Found % |
|---|---|---|
| C | 29.8 | 31.0 |
| H | 1.1 | 1.4 |
| F | 57.2 | 55.7 |
| Cl | 6.3 | 6.1 |
| I | 0 | 0.4 |

Preparation of Dispersion and Testing on Carpet

A dispersion was prepared as described in Example 1, using 352 g of the 67.5% solids methyl isobutyl ketone solution described above. The other ingredients were:

| | |
|---|---|
| Water | 100 ml |
| "Arquad" 18-50 | 18 g |
| Nonionic Surfactant | 73 g |
| 2-Methyl-2,4-pentanediol | 0.5 g |

Homogenization, removal of methyl isobutyl ketone, application to carpet (with and without polymethyl methacrylate) and testing were carried out as described in Example 1. Test results are set forth in Tables 3 and 4.

EXAMPLE 4

Chlorination of the Product of Example 2

In a 500 ml round-bottom flask fitted with a reflux condenser maintained at 0° were placed 160 g of the product of Example 2 and 60 ml of 1,1,2-trichloro-1,2,2-trifluoroethane. The mixture was stirred at 48°–51° and 24 g of chlorine gas were introduced below the surface over a period of about 75 minutes. Then, 20 ml of water was poured down the condenser, followed by 80 ml of a saturated aqueous solution of sodium bisulfite added slowly. The reflux condenser was then removed and the flask was heated to 84°–85° and held at that temperature for about 15 minutes to distill out the chlorofluorocarbon. Next, was added 90 ml of methyl isobutyl ketone. The aqueous lower layer was removed by means of a separatory funnel. The organic layer was washed with 100 ml of hot, concentrated magnesium sulfate solution. Isopropanol (50 ml) was added to facilitate the separation of the aqueous phase. The final wash was 100 ml of water to which 20 ml of isopropanol was added. The resulting solution of the product in methyl isobutyl ketone weighed 237 g and was 56.4% non-volatile, corresponding to 134 g of dry product, 97% of the theoretical yield.

The structure of the product, established by NMR spectroscopy and elemental analysis, is

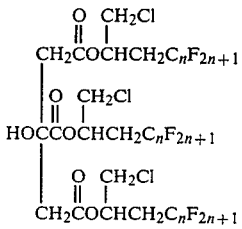

The average value of n in the MPI used as starting material is 8, and therefore the average empirical formula is $C_{39}H_{20}F_{51}O_7Cl_3$. The dried material was analyzed:

| Element | Calc. % | Found % |
|---|---|---|
| C | 27.9 | 28.95 |
| H | 1.2 | 1.2 |
| F | 57.8 | 55.4 |
| Cl | 6.4 | 6.4 |
| I | 0 | 0.4 |

The foregoing elemental analysis gives satisfactory agreement with the theoretical, and supports the structure set forth above.

Preparation of the Dispersion and Testing on Carpet

The dispersion was made as described in Example 1, using 179 g of the methyl isobutyl ketone solution produced as described above. The other ingredients were as described in Example 1, except that no methyl isobutyl ketone was added per se. The dispersion was distilled under vacuum to remove the methyl isobutyl ketone and applied to nylon carpet as hereinbefore described. The results of testing of the treated carpet are set forth in Tables 3 and 4.

EXAMPLE 5

| | |
|---|---|
| $C_6F_{13}I$ | 200.7 g |
| Triallyl citrate | 31.2 g |
| Isooctane | 31.2 g |
| 2,2'-azobis-(isobutyronitrile) | 3.3 g |

All of the above ingredients were combined and deoxygenated. Then the mixture was stirred at 67°–74° for 70 minutes, followed by 150 minutes at 70°–75° and then for 80 minutes at 79°–83°. During the first twenty minutes of the period, the reaction was exothermic and required cooling (after initial heating to bring to reaction temperature). Later, heating was again required.

Volatile materials (87 g) were then removed on the steam bath with aspirator vacuum, using a rotary evaporator. The volatile materials consisted of isooctane (25 g) and perfluorohexyl iodide (62 g). Thus, three mole proportions of perfluoroalkyl iodide had been consumed per mole of triallyl citrate, indicating that the structure of the product is:

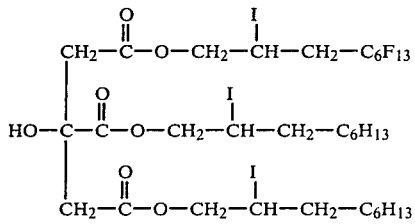

Examination of the product by nuclear magnetic resonance indicated that 94% of the allyl double bonds had been converted to the following structural moiety: $—CF_2—CH_2—CHI—CH_2—$.

The product was dispersed in water and tested on carpet as described in Example 1. The results are set forth in Tables 3 and 4.

EXAMPLE 6

Preparation of Adduct

| | |
|---|---|
| MPI | 154 g |
| Diallylphthalate | 34 g |
| ABI | 1.7 g |

The MPI and the diallylphthalate were mixed and deoxygenated. Then, while maintaining a nitrogen atmosphere, the ABI was added and temperature was controlled according to the following schedule:

| Elapsed Time (min) | Temperature (°C.) | ABI Addition |
|---|---|---|
| 0 | heating from 25 | 0.1 g |
| 15 | 60 | |
| 15–43 | 60–68 | |
| 43 | 68 | 0.1 g |
| 59 | 69.5 | 0.2 g |
| 59–85 | 69–76.5 | |
| 85 | 71.5 | 0.3 g |
| 103 | 71 | 0.5 g |
| 103–148 | 69.5–84 | |
| 148 | 79 | 0.5 g |
| 212 | 74.5–100 | |
| 212 | 91 | reaction terminated |

Preparation of Dispersion and Testing on Carpet

This was carried out as described in Example 1 and the results are recorded in Table 3.

EXAMPLE 7

Preparation of Adduct

| | |
|---|---|
| MPI | 110 g |
| Allyl benzoate | 32 g |
| ABI | 3.55 g |

The procedure was as described in Example 6, with the following schedule for temperature and addition of ABI.

| Elapsed Time (min) | Temperature (°C.) | ABI Addition |
|---|---|---|
| 0 | 61 | 0.1 g |
| 54 | 60 | 0.1 g |
| 122 | 60 | 0.1 g |
| 198 | 60 | 0.4 g |
| 303 | 61 | 0.4 g |
| 720 | 61 cooled | |
| 0 (after rewarming) | 56 | |
| 12 | 59 | 0.4 g |
| 130 | 60 | temperature control reset to 71° |
| 244 | 71 | 0.4 g |
| 439 | 71 | 0.4 g |
| 840 | 72 cooled | |
| 0 (after rewarming) | 56 | |
| 45 | 56–80 | |
| 150 | 80 | 1.05 g |
| 150–745 | 80–90 | briefly cooled to 58° at 258 |
| 745 | 90 | reaction terminated |

Preparation of emulsion and testing on carpet were carried out as described in Example 1 and the results are recorded in Table 3.

EXAMPLE 8

Preparation of the adduct was carried out essentially as described in Example 7, with the following exceptions:

MPI was replaced by $C_8F_{17}I$; and the adduct was purified by recrystallization from isopropanol.

Chlorination of the Adduct

The equipment was the same as used in Example 4. The materials charged were:

| | |
|---|---|
| Adduct (purified) | 125 g |
| 1,1,2-Trichloro-1,2,2-trifluoroethane | 50 ml |

Chlorine gas (15 g) was introduced during two hours, while the flask contents were maintained between 39° and 55°. Thereafter, 20 ml of water were added, followed by 80 ml of a saturated aqueous solution of sodium bisulfite. The mixture separated into 2 layers and was let stand for 25 days.

The layers were separated, the the lower layer was washed with three 200-ml portions of water, to the last of which was added 10 ml of isopropanol. The chlorofluorocarbon was then evaporated in a vacuum oven at 90°–100°. The product was a clear, amber, viscous liquid and weighed 102 g, representing a 94% yield of:

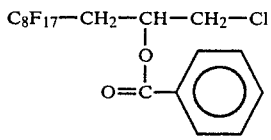

The product crystallized within a day. The structure was established by elemental analysis and NMR spectroscopy, both proton and Carbon-13. The elemental analysis gave the following results:

| | Calc. % | Found % |
|---|---|---|
| C | 35.0 | 34.9 |
| F | 52.4 | 51.7 |
| H | 1.6 | 1.4 |
| Cl | 5.8 | 6.4 |
| I | 0.0 | 0.3 |

To a 400-ml Hastelloy C-lined bomb was added 10 g of the foregoing product, 10 ml of pyridine and 50 ml of isopropanol. The bomb was chilled to about (−)75° C. and evacuated to about 3 mm pressure. Then, the bomb was closed and heated to 160° C. for 4 hours. The bomb was then cooled. The contents were a homogeneous dark amber liquid. Of this liquid, 0.4 g was taken and mixed with 100 ml of water to give a rather turbid solution or suspension. The foregoing solution or suspension has a surface tension of 22.4 dynes/cm., measured by the ring method using a Du Nouy tensiometer.

EXAMPLE 9

In a round-bottom flask equipped with an ice-water-cooled reflux condenser were placed 74 g of the product of Example 6 and 30 ml of 1,1,2-trichloro-1,2,2-trifluoroethane. The mixture was maintained at 51° C. while 15 g of chlorine was added below the surface over a period of 53 minutes. Then, 40 ml of a saturated aqueous solution of sodium bisulfite were added, dropwise, followed by sufficient 30% aqueous sodium hydroxide to bring the pH to about 6 (about 35 ml). The temperature was then raised to 85° to distill out 1,1,2-trichloro-1,2,2-trifluoroethane. The resulting mixture was transferred to a separatory funnel and 50 ml of methyl isobutyl ketone were added. After shaking, the lower layer was discarded and 50 ml of a saturated aqueous solution of magnesium sulfate and 20 ml of isopropanol were added and the mixture was shaken again. The lower layer was again discarded and 50 ml of hot water were added. After shaking, the solution of the product (lower layer) was drawn off.

The product solution was evaporated in vacuum (removing methyl isobutyl ketone) until it weighed 69 grams. Fifty-seven grams of the resulting product were mixed with:

| | |
|---|---|
| "Arquad" 18-50 | 3 g |
| Nonionic surfactant | 1.5 g |
| 2-Methyl-2,4-pentanediol | 0.25 g |
| Water approx. | 60 ml |

The resulting mixture was well agitated in a blender, then diluted with water and mixed with acetic acid. That mixture was sprayed onto nylon carpet so that the face fibers received 0.055% of fluorine (in covalently bound form), 0.01% of acetic acid, and 25% of water based on the weight of the fiber. The carpet was dried and tested as described in Example 1. The test data are set forth in Table 4.

TABLE 3

| Ex. No. | Dry Soil Resistance* (With PMMA) | Oil Repellency (With PMMA) | Water Repellency (With PMMA) |
|---|---|---|---|
| 1 | N-C[a] | 5 | 5 |
| 2 | C-M[a] | 5 | 5 |
| 3 | N-C | 5 | 6 |
| 4 | M | 5-6 | 5-6 |
| 5 | N-C[a] | 5 | 5 |

TABLE 3-continued

| Ex. No. | Dry Soil Resistance* (With PMMA) | Oil Repellency (With PMMA) | Water Repellency (With PMMA) |
|---|---|---|---|
| 6 | C | 5 | 5 |
| 7 | N | 0 | 3 |
| Untreated Carpet | — | 0 | 0 |

*Degree of superiority over untreated carpet
E = equal
N = noticeably better
C = considerably better
M = much better
[a] = 0.11% PMMA

TABLE 4

| Ex. No. | Dry Soil Resistance* (Without PMMA) | Oil Repellency (Without PMMA) | Water Repellency (Without PMMA) |
|---|---|---|---|
| 1 | N-C | 5 | 5 |
| 2 | C | 5 | 5 |
| 3 | S* | 5 | 5 |
| 4 | N | 5 | 5 |
| 5 | MW** | 4 | 5 |
| 9 | M | 3-4 | 5 |

*S = slightly better
**MW = much worse

Tests on Non-woven Fabrics

The diluted dispersions tested on non-woven fabric were:

A. The product of Example 3, dispersed in water as described in Example 3, methyl isobutyl ketone removed as described in said Example. That product was then diluted with water to contain 0.035% of fluorine.

B. The product of Example 4, treated as described in A to contain 0.035% fluorine.

C. The product of Example 9, in the form of a 60% solution in methyl isobutyl ketone, was dispersed in water as described in Example 4. After distillation of the methyl isobutyl ketone, the dispersion was diluted to contain 0.035% fluorine.

The non-woven fabric was a 60% polyester/40% wood pulp fabric intended for use in operating-room garments. The diluted dispersions were padded onto the non-woven fabric to obtain a wet pick-up of 193±5%. They were then dried by passing twice through a mangle heated to 325° F., the heat being applied once on each side of the fabric, with a contact time in the mangle of 75 seconds.

The treated fabrics, as well as an untreated sample, were subjected to the DART* 80.9 test, in which a sample of the fabric is cut to the size of the disc of a standard two-piece mason jar lid. A one-quart mason jar is charged with 600 ml of water containing 0.9% NaCl; the disc is clamped to the top of the jar and the jar is inverted. The time for water to penetrate the disc is recorded as set forth in Table 5.

*Disposables Association Recommended Test

TABLE 5

| Dilute Dispersion Used | Time for Penetration |
|---|---|
| A | >60 min. |
| B | 31 min. |
| C | 5 min. |
| None | instantaneous |

Tests on Kraft Paper

The treating dispersions used were the same type as described in "Tests on Non-woven," but of different concentration. The paper, Claremont unbleached Kraft weighing 20 lbs/100 sq ft, was padded with the dispersions as listed to give 138±2% wet pick-up. The paper was then dried by two passes through a 220° F. mangle, once with each side up. Contact time was 75 seconds. The treated papers and an untreated control were given the AATCC oil repellency test, and the results are given in Table 6.

TABLE 6

| Dispersion | Synthesized Active Ingredient | Treated Paper Fluorine Content | Treated Paper Oil Repellency |
|---|---|---|---|
| D | Ex. 3 | 0.08% | 4–5 |
| E | 3 | 0.04% | 1–2 |
| F | 4 | 0.08% | 5 |
| G | 4 | 0.04% | 1–2 |
| H | 9 | 0.08% | 5 |
| J | 9 | 0.04% | 4 |
| Untreated paper | — | 0.00% | 0 |

EXAMPLE 10

Chlorination of Triallyl Trimellitate Adduct Without Solvent

| | |
|---|---|
| Product of Example 1 | 984 g |
| Chlorine | 117 g |
| Saturated aqueous sodium bisulfite | 290 ml |
| 30% Aqueous sodium hydroxide | 455 ml |

The product of Example 1 (984 g) was charged to a 3-liter round-bottom flask with bottom outlet, furnished with a heating mantle and a cold-finger for tap-water cooling. Nitrogen was passed through the flask while the contents were heated to 85° C. to melt. The contents of the flask were agitated while chlorine gas was introduced below the surface of the liquid as detailed below.

| Elapsed Time (min) | Temperature (°C.) | Action and Remarks |
|---|---|---|
| 0 | 82 | started $Cl_2$ |
| 30 | 84 | 14 g $Cl_2$ in |
| 65 | 83 | 37 g $Cl_2$ in |
| 90 | 76 | 61 g $Cl_2$ in |
| 145 | 61 | 117 g $Cl_2$ in. $Cl_2$ stopped and $N_2$ sweep started |
| 160 | 60 | added 250 ml water |
| 162 | 52 | started addition of $NaHSO_3$ solution |
| 162–200 | 52–79 (fluctuated) | |
| 200 | 68 | stopped addition of $NaHSO_3$ solution |
| 201 | 67 | started addition of NaOH solution |
| 220 | 63 | stopped addition of NaOH solution pH = 3.7 |

Agitation was stopped and the mixture was allowed to cool to room temperature and stand overnight. The following morning, the mixture was heated to 70° C. and the upper, aqueous layer was siphoned off. Water (400 ml) and 490 ml of methyl isobutyl ketone were added, and the mixture was heated with agitation from 55° to 68° C. Agitation was stopped and the upper, aqueous layer was siphoned off. Water (400 ml, preheated to 75°–80° C.) was added and the mixture was agitated for 15 minutes at 70°–80° C. Agitation was stopped and the lower, organic layer was drained out. It weighed 1245 g. A sample was dried in vacuum oven at 90°–100° C. for one hour and showed 64.7% non-volatiles, correspnding to 806 g of product, a 95% yield. NMR (proton) examination of the vacuum-dried product confirmed that the product of Example 3 had been duplicated.

EXAMPLE 11

Chlorination of Triallyl Citrate Adduct Without Solvent

| | |
|---|---|
| Product of Example 2 | 399.6 g |
| Chlorine | 45 g |
| Saturated aqueous sodium bisulfite | 210 ml |
| 30% Aqueous sodium hydroxide | 105 ml |

A one-liter round-bottom flask with bottom outlet was used. A mantle (Glas-Col) was used for heating. The product of Example 2 was charged to the flask at room temperature and was melted under nitrogen. Then, the contents of the flask were agitated while chlorine gas was introduced below the liquid surface, according to the following schedule:

| Elapsed Time (min) | Temperature (°C.) | Action and Remarks |
|---|---|---|
| 0 | 83 | $Cl_2$ started |
| 20 | 85 | 11 g $Cl_2$ in |
| 50 | 83 | 29 g $Cl_2$ in |
| 78 | 83 | 45 g $Cl_2$ in. $Cl_2$ stopped. $N_2$ sweep started |
| 100 | 83 | Added 200 ml $H_2O$ |
| 101 | 58 | reheating to 80–85° |
| 110 | 81 | started addition of $NaHSO_3$ solution |
| 125 | 84 | finished addition of $NaHSO_3$ solution |
| 130 | 83 | started addition of NaOH solution |
| 160 | | finished addition of NaOH solution |
| 170 | 85 | pH = 3.5 |

Agitation was stopped at this point and the upper, aqueous layer was siphoned off. Then, 300 ml. water were added and the mixture was reheated to 88° C. with agitation. Agitation was stopped and the molten product (330 g) was drained off the bottom. A sample of the product was dried at 100° C. in a vacuum oven and showed 95% non-volatiles. That represents 91% of the theoretical yield. Elemental analysis gave the following results:

| Element | Calc. % | Found % |
|---|---|---|
| C | 27.9 | 31.62 |
| Cl | 6.4 | 6.4 |
| F | 57.8 | 56.6 |
| H | 1.2 | 0.98 |
| I | 0.0 | 0.76 |

NMR (proton) and elemental analysis indicate the product has the structure given in Example 4.

EXAMPLE 12

Preparation of MPI/Diallyl Isophthalate (DAIP) Adduct

| Preparation of MPI/Diallyl Isophthalate (DAIP) Adduct | |
|---|---|
| MPI | 8655 g |
| DAIP | 1980 g |
| ABI | 60 g |

All of the MPI was placed in a round-bottom flask, set in a water bath for temperature control. Of the DAIP, 600 ml. were added and the mixture was deoxygenated. The mixture was heated to 72°±3° C., and the following schedule of additions was followed:

| Elapsed Time | ABI Addition (g) | DAIP Addition (ml) |
|---|---|---|
| 0 | 6 | |
| 58 | | 200 |
| 60 | 6 | |
| 89 | | 200 |
| 118 | | 200 |
| 120 | 6 | |
| 178 | | 200 |
| 180 | 6 | |
| 238 | | 200 |
| 240 | 6 | |
| 298 | | remainder |
| 300 | 6 | |
| 360 | 6 | |
| 420 | 6 | |
| | 28 | |
| 480 | 6 | |
| 540 | 6 | |
| 1410 | temperature raised to 76° (material was partially frozen) | |
| 1410–1450 | temperature gradually raised to 82° to melt product | |
| 1485 | reaction terminated | |

Chlorination of Adduct

The above-described adduct (4000 g) and 1,1,2-trichloro-1,2,2-trifluoro ethane (2775 g.) were placed in a round-bottom flask with bottom outlet and reflux condenser and heated until stirrable, approximately 40° C. Chlorine (520 g) was added below the surface of the liquid over a 3.5 hour period, while the temperature was maintained between 35° and 50° C., then 1 liter of water was added. Over a period of 2.5 hours, 2200 ml. of a saturated aqueous sodium bisulfite solution were added at a temperature in the range between 32°–50° C. While cooling so as to maintain the temperature in the range between 30° and 50° C., 30% aqueous sodium hydroxide was added. When after 1.5 hours, the pH reached 5.4, addition of the aqueous sodium hydroxide was terminated, 1865 ml. thereof having been used. During the addition of the sodium hydroxide solution, some salts formed inside the neck of the flask. One liter of water was used in periodically rinsing the salts from the neck of the flask. The mixture was let stand for 0.5 hour and then the top layer (aqueous) was drawn off. Water (2900 ml.), 1,1,2-trichloro-1,2,2-trifluoromethane (250 ml.), isopropanol (250 ml.) were added and the mixture was agitated and then allowed to stand. The product, in solution in chlorofluorocarbon (a pale amber solution) was drawn off the bottom. The product, weighing 534 g was 57.4% solids (by drying in vacuum oven, 90°–100° C.), corresponding to 3072 g. of product, a 83.6% yield. The product, in solution, is a very pale amber liquid. NMR is consistent with the following structure:

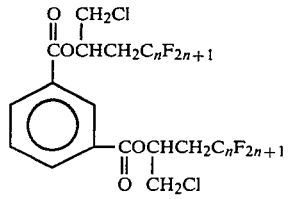

We claim:

1. A process which comprises reacting chlorine with a reactant compound having the formula:

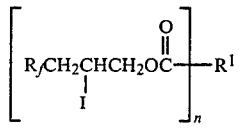

so as to produce an end-product compound having the formula:

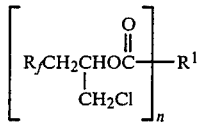

wherein $R_f$ is a saturated, monovalent, nonaromatic fluorinated aliphatic which is straight or branched chain or cyclic and contains at least 3 carbons;

$R^1$ is optionally substituted alkyl, aryl, alkenyl, aralkyl, cycloalkyl, or cycloalkenyl; and n is a number from 1 to 4; during said reaction, said reactant compound being in molten form or dissolved or suspended in a liquid medium which is inert under the reaction conditions.

2. A process of claim 1 wherein $R_f$ is a perfluoroalkyl containing 3 to 20 carbons; and n is 2 to 4.

3. A process of claim 2 wherein $R_f$ is a perfluoroalkyl containing 3 to 20 carbons; $R^1$ is derived from citric, o-, m- or p-phthalic acid, succinic, chlorendic, or a benzene polycarboxylic acid and n is 2 to 4.

4. A process of claim 3 wherein $R^1$ is derived from citric acid.

5. A process of claim 3 wherein $R^1$ is derived from o-phthalic acid.

6. A process of claim 3 wherein $R^1$ is derived from isophthalic acid.

7. A process of claim 3 wherein $R^1$ is derived from trimellitic acid.

8. A process of claim 3 wherein $R^1$ is derived from pyromellitic acid.

9. A process of any one of claims 1 to 8 wherein $R_f$ contains 4 to 16 carbons.

10. A process of claim 9 wherein $R_f$ has an average value of 6 to 8 carbons.

* * * * *